US011019884B2

(12) United States Patent
Madore

(10) Patent No.: US 11,019,884 B2
(45) Date of Patent: Jun. 1, 2021

(54) SOLE STRUCTURE HAVING A MIDSOLE COMPONENT WITH MOVABLE TRACTION MEMBERS

(71) Applicant: NIKE, Inc., Beaverton, OR (US)

(72) Inventor: Carl L. Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 577 days.

(21) Appl. No.: 15/359,844

(22) Filed: Nov. 23, 2016

(65) Prior Publication Data

US 2018/0140052 A1 May 24, 2018

(51) Int. Cl.

| | |
|---|---|
| ***A43C 15/16*** | (2006.01) |
| ***A43B 5/00*** | (2006.01) |
| ***A43B 13/18*** | (2006.01) |
| ***A43B 13/12*** | (2006.01) |
| ***A43B 7/14*** | (2006.01) |
| ***A43B 13/26*** | (2006.01) |

(52) U.S. Cl.

CPC ..... *A43C 15/161* (2013.01); *A43B 5/001* (2013.01); *A43B 7/149* (2013.01); *A43B 13/127* (2013.01); *A43B 13/186* (2013.01); *A43B 13/26* (2013.01); *A43C 15/162* (2013.01)

(58) Field of Classification Search

CPC ..... A43B 13/26; A43B 5/001; A43B 13/18; A43B 13/186; A43B 13/127; A43B 7/149; A43B 7/146; A43C 15/16; A43C 15/162; A43C 15/161

USPC ..... 36/61, 28, 43, 30 R

See application file for complete search history.

(56) References Cited

U.S. PATENT DOCUMENTS

| | | | | |
|---|---|---|---|---|
| 303,287 A | | 8/1884 | Hunn | |
| 1,542,671 A | * | 6/1925 | Craig | A43C 15/162 36/129 |
| 3,352,034 A | * | 11/1967 | Braun | A43C 15/162 36/67 D |
| 3,577,663 A | * | 5/1971 | Mershon | A43C 15/162 36/67 D |
| 3,859,739 A | * | 1/1975 | Dassler | A43C 15/162 36/67 D |
| 4,233,759 A | * | 11/1980 | Bente | A43B 13/26 36/32 R |
| 4,271,608 A | | 6/1981 | Tomuro | |

(Continued)

FOREIGN PATENT DOCUMENTS

| | | |
|---|---|---|
| DE | 3046811 A1 | 7/1982 |
| EP | 0223700 A1 | 5/1987 |

*Primary Examiner* — Nathan E Durham
*Assistant Examiner* — Abby M Spatz
(74) *Attorney, Agent, or Firm* — Quinn IP Law

(57) ABSTRACT

A sole structure includes a midsole component including a midsole body, a plurality of traction members, and a securing layer. The midsole body defines an outer midsole surface and an inner midsole surface opposite the outsole midsole surface. The traction members are coupled to the midsole body. Each of the traction members includes a base and a traction body protruding from the base away from the inner midsole surface. The traction body extends through the midsole body, and the base abuts the inner midsole surface. As such, that the traction members are movable relative to the midsole body. The securing layer is disposed over the base, and is coupled to the inner midsole surface to hold the plurality of traction members in contact with the midsole component.

17 Claims, 6 Drawing Sheets

(56) References Cited

U.S. PATENT DOCUMENTS 4,393,604 A * 7/1983 Crowley ..... A43C 15/162 36/126
4,561,197 A * 12/1985 Misevich ..... A43C 15/161 36/127
4,715,133 A 12/1987 Hartjes et al.
5,367,791 A * 11/1994 Gross ..... A43B 13/181 36/25 R
5,483,760 A * 1/1996 Kataoka ..... A43B 5/06 36/129
5,555,584 A * 9/1996 Moore, III ..... A43B 7/28 12/142 N
5,794,367 A * 8/1998 Carroll ..... A43C 15/162 36/127
6,256,907 B1 * 7/2001 Jordan ..... A43C 15/14 36/134
6,357,146 B1 * 3/2002 Wordsworth ..... A43C 15/16 36/128
6,698,110 B1 * 3/2004 Robbins ..... A43B 5/185 36/134
6,915,596 B2 * 7/2005 Grove ..... A43B 13/223 36/100
D541,017 S * 4/2007 McClaskie ..... D2/951
7,204,044 B2 4/2007 Hoffer et al.
7,254,909 B2 8/2007 Ungari
8,079,160 B2 12/2011 Baucom et al.
9,591,891 B1 * 3/2017 Baucom ..... A43B 13/14
2002/0144438 A1 * 10/2002 Better ..... A43B 5/001 36/127
2010/0077635 A1 * 4/2010 Baucom ..... A41D 13/065 36/61
2010/0083541 A1 * 4/2010 Baucom ..... A43B 1/0018 36/25 R
2011/0192056 A1 * 8/2011 Geser ..... A43B 13/26 36/114
2013/0061498 A1 * 3/2013 Droege ..... A43B 5/02 36/25 R
2013/0239437 A1 * 9/2013 Baker ..... A43B 13/26 36/61
2014/0196087 A1 7/2014 Park et al.
2014/0215857 A1 * 8/2014 Curl ..... A43B 5/001 36/134
2015/0181977 A1 * 7/2015 Klug ..... A43B 13/26 36/134
2015/0196087 A1 * 7/2015 Meschter ..... A43B 13/18 36/25 R
2015/0237957 A1 * 8/2015 Cross ..... A43B 13/14 36/30 R
2015/0237958 A1 * 8/2015 Cross ..... A43B 13/181 36/103
2015/0245686 A1 * 9/2015 Cross ..... A43B 13/02 36/29
2015/0374068 A1 * 12/2015 Duke ..... A43B 5/02 36/28
2016/0051011 A1 * 2/2016 Francis ..... A43B 5/00 36/59 C
2016/0255911 A1 * 9/2016 Fujita ..... A43B 13/125
2019/0008232 A1 * 1/2019 Chaney ..... A43B 13/26

* cited by examiner

SOLE STRUCTURE HAVING A MIDSOLE COMPONENT WITH MOVABLE TRACTION MEMBERS

TECHNICAL FIELD

The present disclosure relates to a sole structure for an article of footwear. In particular, the present disclosure relates to a sole structure including a midsole component with movable traction members.

BACKGROUND

Footwear typically includes a sole configured to be located under a wearer's foot to space the foot away from the ground or floor surface. Soles can be designed to provide a desired level of cushioning. The ground contact surface of the article of footwear can be configured for durability.

SUMMARY

Sole structures should provide stability, support, and traction, while maintaining flexibility, during a golf swing. By minimizing foot slippage, while allowing foot flexion, the sole structure enables a golfer to enhance its distance, speed, and accuracy during a golf swing. The presently disclosed sole structure can be part of an article of footwear, such as a golf shoe, and maximizes foot traction while not encumbering foot flexibility. To do so, the presently disclosed sole structure includes a midsole component and traction members movably coupled to the midsole component. The midsole component includes a midsole body. The midsole body defines an outer midsole surface and an inner midsole surface opposite the outer midsole surface. The traction members are coupled to the midsole body. Each traction member includes a base and a traction body protruding from the base away from the inner midsole surface. The traction body extends through the midsole body, and the base abuts the inner midsole surface. As such, the traction members are movable relative to the midsole body. The securing layer is disposed over the base and is coupled to the inner midsole surface to hold the plurality of traction members in contact with the midsole component.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively for the figures, and do not represent limitations on the scope of the present teachings, as defined by the claims.

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

The above features and advantages and other features and advantages of the present teachings are readily apparent from the following detailed description of the best modes for carrying out the teachings when taken in connection with the accompanying drawings.

DETAILED DESCRIPTION

Figure 1:
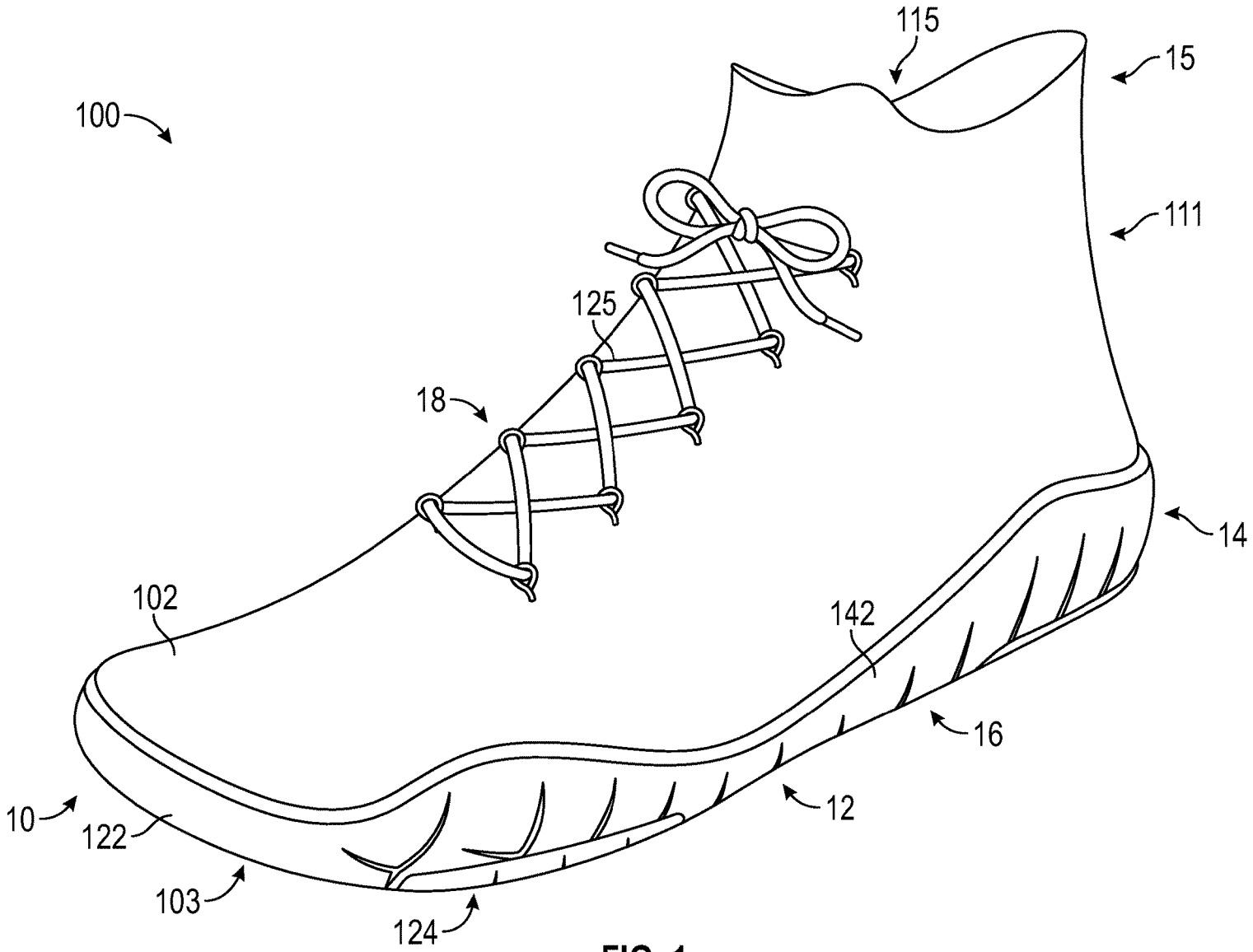
FIG. 1 is a schematic, isometric view of an embodiment of an article of footwear.

Referring to the drawings, wherein like reference numbers correspond to like or similar components throughout the several figures, and FIG. 1 schematically illustrates an embodiment of an article of footwear 100. In the exemplary embodiment, article of footwear 100 has the form of a golf shoe. However, in other embodiments, the provisions discussed herein for the article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of the article of footwear 100, also referred to simply as the article of footwear 100. However, it will be understood that other embodiments may incorporate a corresponding article of footwear (e.g., a right article of footwear when article of footwear 100 is a left article of footwear) that may share some, and possibly all, of the features of article of footwear 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of an inner sole component, a midsole component, an outer sole component, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed farther from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

The article of footwear 100 may be characterized by a number of different regions or portions. For example, the article of footwear 100 could include a forefoot portion, a midfoot portion, a heel portion and an ankle portion. Moreover, components of the article of footwear 100 could likewise comprise corresponding portions. Referring to FIG. 1, the article of footwear 100 may be divided into the article forefoot portion 10, the article midfoot portion 12, and the article heel portion 14. The article forefoot portion 10 may be generally associated with the toes and joints connecting the metatarsals with the phalanges. The article midfoot portion 12 may be generally associated with the arch of a foot. Likewise, the article heel portion 14 may be generally associated with the heel of a foot, including the calcaneus bone. The article of footwear 100 may also include an ankle portion 15 (which may also be referred to as a cuff portion). In addition, the article of footwear 100 may include an article lateral side 16 and an article medial side 18. In particular, the article lateral side 16 and the article medial side 18 may be opposing sides of the article of footwear 100. Furthermore, both the article lateral side 16 and the article medial side 18 may extend through article forefoot portion 10, the article midfoot portion 12, the article heel portion 14 and the ankle portion 15.

Figure 2:
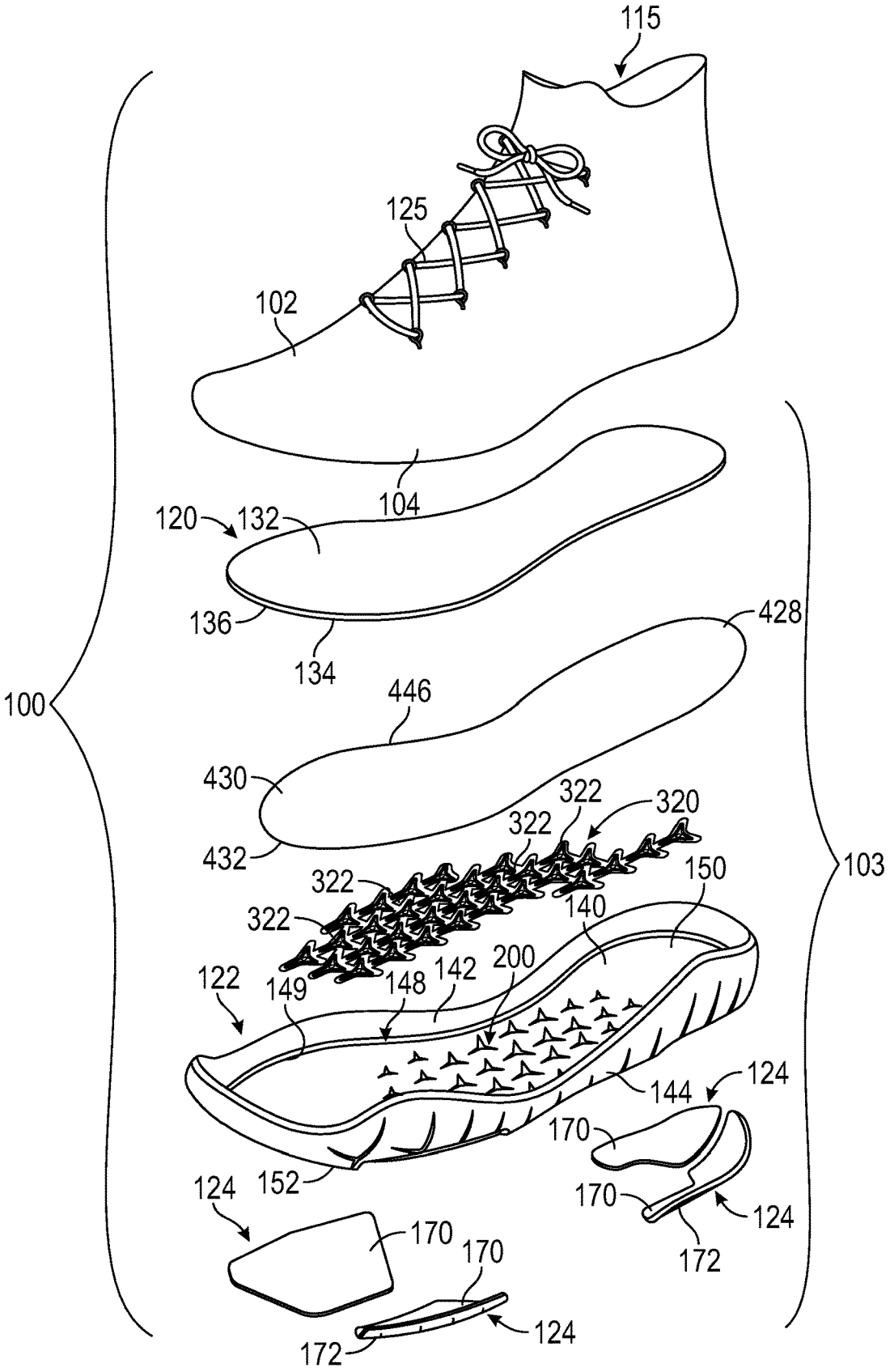
FIG. 2 is a schematic, exploded isometric view of an embodiment of an article of footwear.

FIG. 2 illustrates an exploded isometric view of an embodiment of the article of footwear 100. FIGS. 1 and 2 illustrate various components of article of footwear 100, including an upper 102 and a sole structure 103.

Generally, the upper 102 may be any type of upper. In particular, the upper 102 may have any design, shape, size and/or color. For example, in embodiments where the article of footwear 100 is a basketball shoe, the upper 102 could be a high top upper that is shaped to provide high support on an ankle. In embodiments where article of footwear 100 is a golf shoe 111, the upper 102 could be a low top upper.

In some embodiments, the upper 102 includes an upper opening 115 that provides entry for the foot into an interior cavity of upper 102. In some embodiments, the upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of the upper 102.

Some embodiments may include uppers that extend beneath the foot, thereby providing 360 degree coverage at some regions of the foot. However, other embodiments need not include uppers that extend beneath the foot. In other embodiments, for example, the upper 102 could have a lower periphery joined with a sole structure and/or sock liner.

The upper 102 could be formed from a variety of different manufacturing techniques resulting in various kinds of upper structures. For example, in some embodiments, an upper could have a braided construction, a knitted (e.g., warp-knitted) construction or some other woven construction. In an exemplary embodiment, the upper 102 may be a knitted upper.

The article of footwear 100 includes a sole structure 103 configured to provide traction. In addition to providing traction, the sole structure 103 may attenuate ground reaction forces when compressed between the foot and the ground during walking, running or other ambulatory activities. The configuration of the sole structure 103 may vary significantly in different embodiments to include a variety of conventional or non-conventional structures. In some cases, the configuration of the sole structure 103 can be configured according to one or more types of ground surfaces on which the sole structure 103 may be used. Examples of ground surfaces include, but are not limited to: natural turf, synthetic turf, dirt, hardwood flooring, as well as other surfaces.

The sole structure 103 is secured to the upper 102 and extends between the foot and the ground when the article of footwear 100 is worn. In different embodiments, the sole structure 103 may include different components. In the exemplary embodiment shown in FIGS. 1 and 2, the sole structure 103 may include an inner sole component 120, a midsole component 122, and one or more outer sole members 124. In some cases, one or more of these components may be optional.

Referring now to FIG. 2, in some embodiments, the inner sole component 120 may be configured as an inner layer for a midsole and may be referred to as the insole. For example, as discussed in further detail below, inner sole component 120 may be integrated, or received, into a portion of the midsole component 122. However, in other embodiments, inner sole component 120 could function as an insole layer and/or as a strobel layer. Thus, in at least some embodiments, the inner sole component 120 could be joined (e.g., stitched or glued) to the lower portion 104 of the upper 102 for purposes of securing the sole structure 103 to the upper 102.

The inner sole component 120 may have an inner insole surface 132 and an outer insole surface 134. The inner insole surface 132 may generally be oriented towards the upper 102. The outer insole surface 134 may be generally oriented towards the midsole component 122. Furthermore, a peripheral sidewall insole surface 136 may extend between inner insole surface 132 and outer insole surface 134.

The midsole component 122 may be configured to provide cushioning, shock absorption, energy return, support, as well as possibly other provisions. To this end, the midsole component 122 may have a geometry that provides structure and support for article of footwear 100, and the material for the midsole component 122 may be selected to provide a desirable combination of durability and flexibility. For instance, the midsole component 122 may be wholly or partly made of a thermoplastic or other suitably durable material. As a non-limiting example, the midsole component 122 is wholly or partly made of ethylene vinyl acetate (EVA). As a non-limiting example, the midsole component 100 may be made of sixty percent EVA and forty percent rubber to minimize the weight of the midsole component 122. Carbon rubber may be added to in high wear areas of the midsole component 122. Carbon rubber is synthetic rubber with carbon added. Specifically, the midsole component 122 may be seen to have a lower portion 140 and a sidewall portion 142. The sidewall portion 142 may extend around the entire periphery 144 of the midsole component 122. As seen in FIG. 1, the sidewall portion 142 may partially wrap up the sides of article of footwear 100 to provide increased support along the base of the foot. The midsole component 122 can be a single-piece or unitary structure and can be manufactured using an insert molding process, such as injection molding and compression molding.

The midsole component 122 includes a midsole body 121 defining an inner midsole surface 150 and an outer midsole surface 152 opposite the inner midsole surface 150. The midsole body 121 may be a one-piece structure to enhance the structural integrity of the midsole component 122. The outer midsole surface 152 may also be referred as the ground-facing surface. The inner midsole surface 150 may be generally oriented towards the upper 102, while the outer midsole surface 152 may be oriented outwardly. Furthermore, in the exemplary embodiment, the midsole component 122 includes a central recess 148 disposed the inner midsole surface 150. The central recess 148 may generally be sized and configured to receive the inner sole component 120. The midsole component 122 may be divided into the midsole forefoot portion 123, the midsole portion 129, and the midsole heel portion 131. The midsole component 122 also has a midsole lateral edge 133 and a midsole medial edge 135 opposite the midsole lateral edge 133. The midsole lateral edge 133 and the midsole medial edge 135 both extend around the periphery of the midsole component 122 from a foremost edge 137 to the rearmost edge 139 of the midsole component 122.

In some embodiments, the midsole component 122 may include a plurality of openings 200, at least some of which may extend through the entire thickness of the midsole component 122. In the exemplary embodiment shown in FIG. 2, some of the openings 200 are visible within central recess 148.

In different embodiments, the midsole component 122 may generally incorporate various provisions associated with midsoles. For example, in one embodiment, the midsole component 122 may be formed from a polymer foam material that attenuates ground reaction forces (i.e., provides cushioning) during walking, running, and other ambulatory activities. In various embodiments, the midsole component 122 may also include fluid-filled chambers, plates, moderators, or other elements that further attenuate forces, enhance stability, or influence the motions of the foot, for example.

Figure 3:
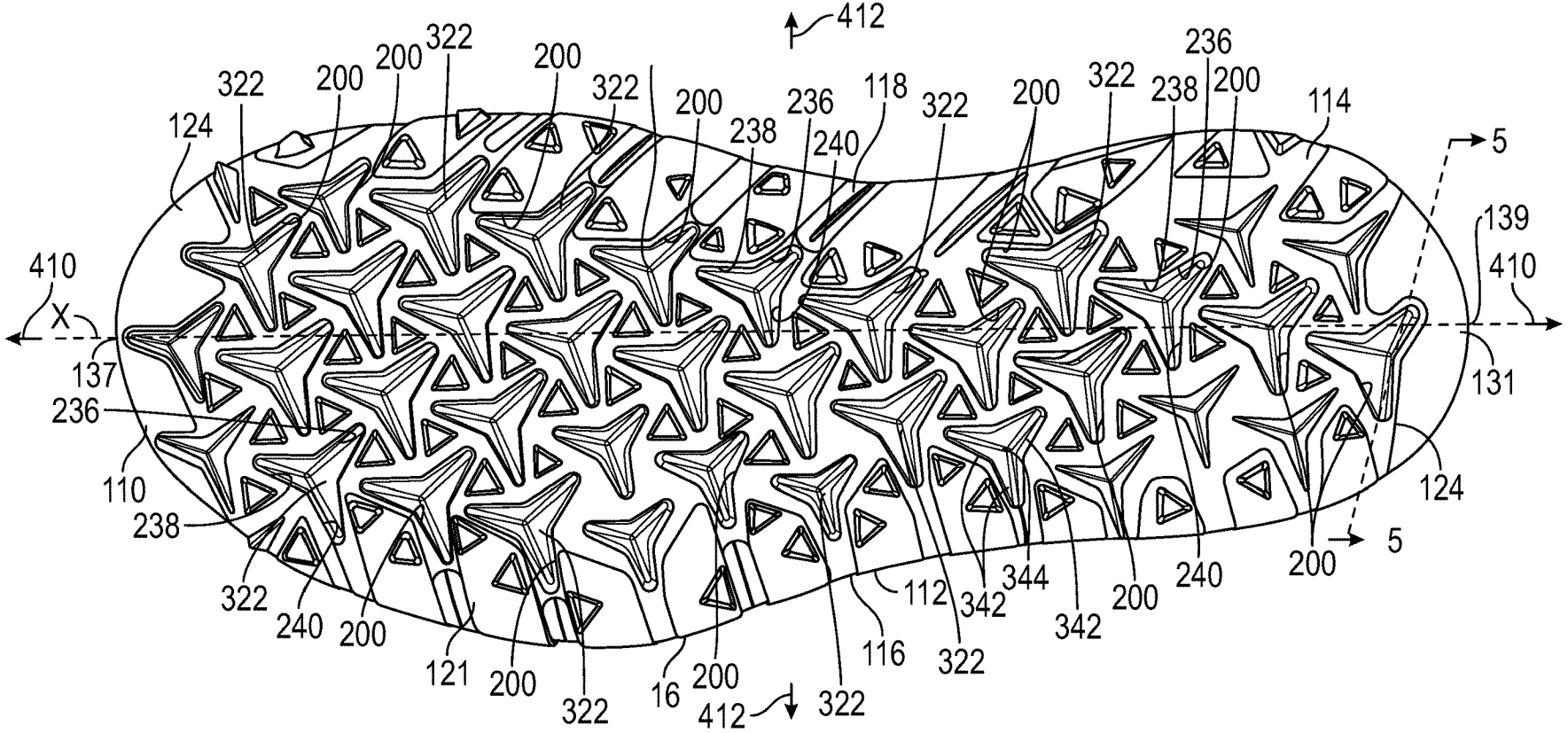
FIG. 3 is a schematic, bottom view of a sole structure of an embodiment of an article of footwear.

FIG. 3 illustrates a bottom view of the sole structure 103. The sole structure 103 may be divided into the sole forefoot portion 110, the sole midfoot portion 112, and the sole heel portion 114. The sole structure 103 also has a sole lateral side 116 and a sole medial side 118 opposite the sole lateral side 116. Further, the sole structure 103 is elongated along a longitudinal axis X.

To increase the resiliency of the sole structure 103, one or more toughened portions may be comolded or adhered with the midsole component 122. These toughened portions (e.g., outer sole members 124) may be formed from a material that has comparatively higher rubber content and/or other additives to increase the durometer and wear resistance of these portions. In different embodiments, the locations of one or more outer sole members 124 could vary. In some embodiments, one or more outer sole members 124 could be disposed in the sole forefoot portion 110 of the sole structure 103. In other embodiments, one or more outer sole members 124 could be disposed in the sole midfoot portion 112 of the sole structure 103. In still other embodiments, one or more outer sole members 124 could be disposed in the sole heel portion 114 of the sole structure 103. In the embodiment shown in FIG. 2, two outer sole members 124 are disposed in the article sole forefoot portion 110 of the sole structure 103, while another two outer sole members 124 are disposed in the sole heel portion 114.

In the embodiment depicted in FIG. 2, the sole structure 103 includes four outer sole members 124, while, in the embodiment depicted in FIG. 3, the sole structure 103 includes two outer sole members 124. Although the exemplary embodiment includes a specific number of outer sole members 124, other embodiments could include any other number of outer sole members 124. For instance, only a single outer sole member 124 may be present. Regardless of the quantity, each outer sole member 124 is configured as a ground contacting member. In some embodiments, the outer sole member 124 could include properties associated with outsoles, such as durability, wear-resistance and increased traction. In other embodiments, the outer sole member 124 could include properties associated with a midsole, including cushioning, strength and support. In the exemplary embodiment, plurality of outer sole members 124 may be configured as outsole-like members that enhance traction with a ground surface while maintaining wear resistance. The sizes of various outer sole members 124 could vary.

With continued reference to FIGS. 2 and 3, each outer sole member 124 defines an inner outsole surface 170 and an outer outsole surface 172. The inner outsole surface 170 may generally be disposed against midsole component 122. The outer outsole surface 172 may face outwardly and may be a ground contacting surface. The midsole component 122 and the outer sole members 124 may be a one-piece structure in order to enhance the structural integrity of the sole structure 103. Alternatively, the outer sole members 124 may be discrete components coupled to the midsole component 122, thereby enhancing the flexibility of the sole structure 103. The outer sole members 124 may be bonded or otherwise attached to the midsole component 122. Such bonding or attachment could be accomplished using any known methods for bonding components of articles of footwear, including, but not limited to: adhesives, films, tapes, stitching, or other methods.

In the exemplary embodiment, the inner sole component 120 may be disposed within central recess 148 of the midsole component 122. More specifically, outer insole surface 134 of the inner sole component 120 may be oriented towards, the inner midsole surface 150 of the midsole component 122. Furthermore, in some cases, the peripheral sidewall insole surface 136 of the inner sole component 120 may be in contact with the midsole component 122 along an inner recess sidewall 149. In addition, plurality of outer sole members 124 may be disposed against outer midsole surface 152 of the midsole component 122. For example, the inner outsole surface 170 of the outer sole members 124 may face towards, and be in contact with, the outer midsole surface 152 of the midsole component 122. In some embodiments, when assembled, the midsole component 122 and the inner sole component 120 could comprise a composite midsole assembly, or dual layered midsole assembly.

In different embodiments, the upper 102 and sole structure 103 could be joined in various ways. In some embodiments, upper 102 could be joined to inner sole component 120, e.g., using an adhesive or by stitching. In other embodiments, the upper 102 could be joined to the midsole component 122, for example, along sidewall portion 142. In still other embodiments, the upper 102 could be joined with both inner sole component 120 and the midsole component 122. Moreover, these components may be joined using any methods known in the art for joining sole components with uppers, including various lasting techniques and provisions (e.g., board lasting, slip lasting, etc.).

The midsole component 122 can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction). As a consequence, the sole structure 103 has an auxetic structure or configuration. Auxetic structures have a negative Poisson's ratio, such that when they are under tension in a first direction, their dimensions increase both in the first direction and in a second direction orthogonal or perpendicular to the first direction.

Figure 4:
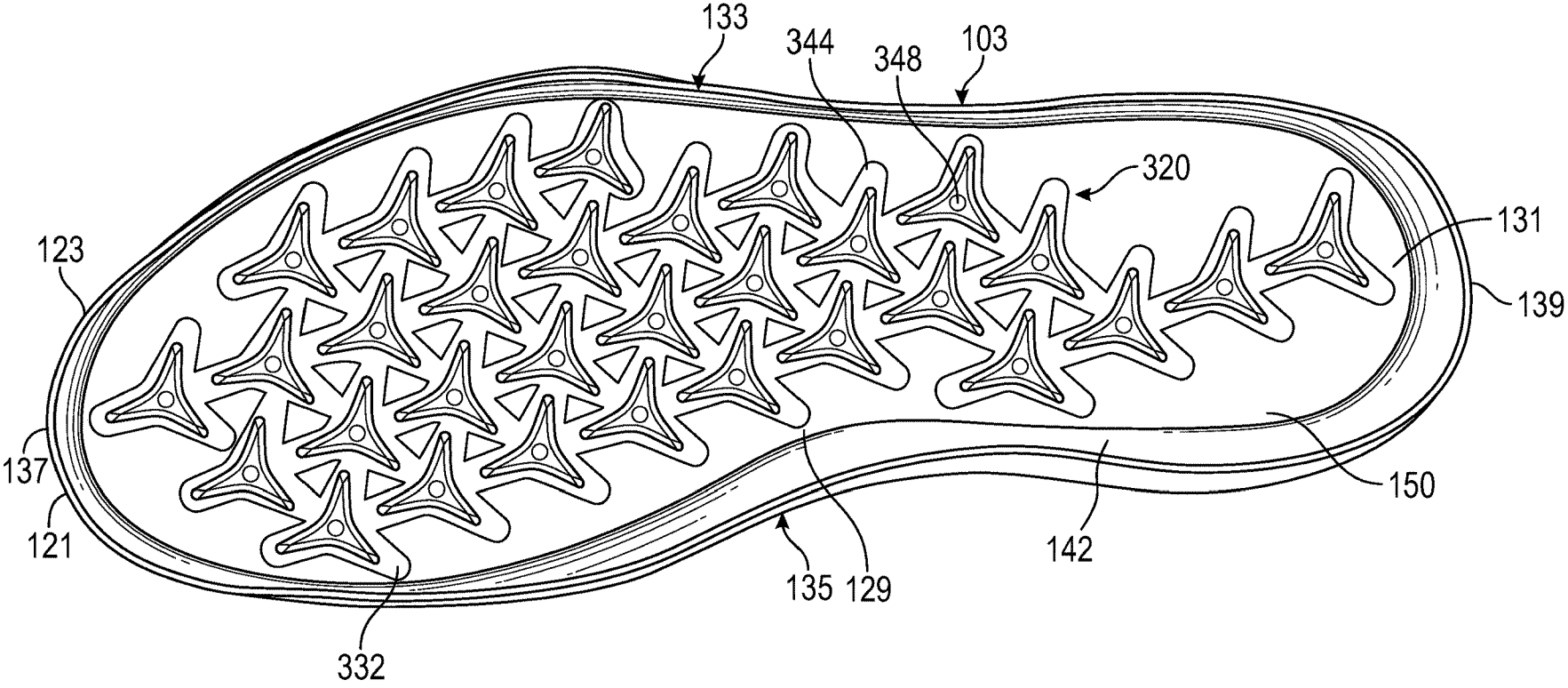
FIG. 4 is a schematic, top view of the sole structure shown in FIG. 1, without a securing layer.

As seen in FIGS. 2-4, the sole structure 103 may include a plurality of openings 200. As used herein, the term "opening" refers to any hollowed area or recessed area in a component. In some cases, an opening may be a through hole, in which the opening extends between two opposing surfaces of a component. In other cases, an opening may be a blind-hole, in which the hole may not extend through the entire thickness of the component and may therefore only be open on one side. A component, such as the midsole component 122, may utilize a combination of through holes and blind-holes.

One or more openings 200 may extend through the entire thickness of the midsole component 122. It is envisioned that all the openings 200 may be through-holes extending through the entire thickness of the midsole component 122. In some embodiments, the openings 200 may spread along the sole forefoot portion 110, the sole midfoot portion 112, and the sole heel portion 114. In other embodiments, the openings 200 may not extend through each of these portions. The openings 200 may also extend through the plurality of outer sole members 124. However, in other embodiments, one or more outer sole members 124 may not include any openings.

In different embodiments, the geometry of one or more openings 200 could vary. Moreover, embodiments could also utilize any other geometries, such as utilizing sole portions with parallelogram geometries or other polygonal geometries that are arranged in a pattern to provide the sole with an auxetic structure. In the exemplary embodiment, each opening 200 has a tri-star geometry, including three arms or points extending from a common center. Various embodiments of the sole structure 103 may define any of the auxetic opening, including both the size, shape and arrangement, that are disclosed in U.S. Patent Publication Number 2015/0237958, titled "Midsole Component and Outer Sole Members with Auxetic Structure," the entire disclosure of which is herein incorporated by reference as well as any openings disclosed in U.S. Patent Publication Number 2015/0237957, titled "Multi-Component Sole Structure Having an Auxetic Configuration," the entire disclosure of which is also herein incorporated by reference. In addition, embodiments can make use of any of the auxetic openings, including both the size, shape and arrangement, that are disclosed in U.S. Patent Publication Number 2015/0245686, titled "Sole Structure with Holes Arranged in Auxetic Configuration", the entire disclosure of which is herein incorporated by reference.

With continuing reference to FIGS. 2-4, as a non-limiting example, each of the openings 200 is star-shaped in order to provide the midsole component 122 with auxetic properties. In the depicted embodiment, for example, each opening 200 is shaped as an isotoxal star polygon. In the present disclosure, the term "isotoxal" refers to geometry of a polytope (e.g., a polygon, a polyhedron or tiling), which symmetries act transitively on its edges. The isotoxal star polygonal shape of the openings 200 provides the midsole component 122 with auxetic properties. Each opening 200 has a first triangular void 236, a second triangular void 238, and a third triangular void 240 directly interconnected with one another at a common point. The first triangular void 236 is obliquely angled relative to the second triangular void 238 and the third triangular void 240. The second triangular void 238 is obliquely angled relative to the third triangular void 240. The angular orientations of the first triangular void 236, the second triangular void 238, and the third triangular void 240 relative to one another provide the midsole component 122 with auxetic properties.

The openings 200 may be arranged on sole structure 103 in an auxetic pattern, or auxetic configuration. In other words, plurality of openings 200 (e.g., thru-holes) may be arranged on midsole component 122 and/or outer sole members 124 in a manner that allows those components to undergo auxetic motions, such as expansion or contraction. An example of auxetic expansion, which occurs as the result of the auxetic configuration of plurality of openings 200. In a non-tensioned state, the openings 200 have an un-tensioned area. As tension is applied across sole structure 103 along an exemplary linear direction 410 (e.g., a longitudinal direction), as shown in FIG. 3, the sole structure 103 undergoes auxetic expansion. That is, the sole structure 103 expands along direction 410, as well as in a second direction 412, which is perpendicular to direction 410.

The sole structure 103 further includes a plurality of traction members 322, such as cleats or spikes, indirectly coupled to the midsole body 121. The traction members 322 provide traction to the wearer of the article of footwear 100. At least some or all of the openings 200 partly receive one of the traction members 322. The sole structure 103 also includes a securing layer 428 directly coupled to the inner midsole surface 150 to hold the traction members 322 in direct contact with the midsole component 122. The securing layer 428 may be made of a waterproof material and is wholly or partly made of a flexible material, such as a fabric, in order to provide flexibility to the sole structure 103. As discussed below, the securing layer 428 is disposed over the traction members 322 and the midsole body 121, such that the traction members 322 are disposed between the securing layer 428 and the inner midsole surface 150 of the midsole component 122. As a consequence, the securing layer 428 holds the traction members 322 in direct contact with the midsole component 122, while still permitting localized, relative movement between the traction members 322 and the inner midsole surface 150 of the midsole body 121. The securing layer 428 defines an inner layer surface 430 and an outer layer surface 432. The inner layer surface 430 may generally be oriented towards the inner sole component 120, and the outer layer surface 432 may be generally oriented towards the midsole component 122.

Figure 6:
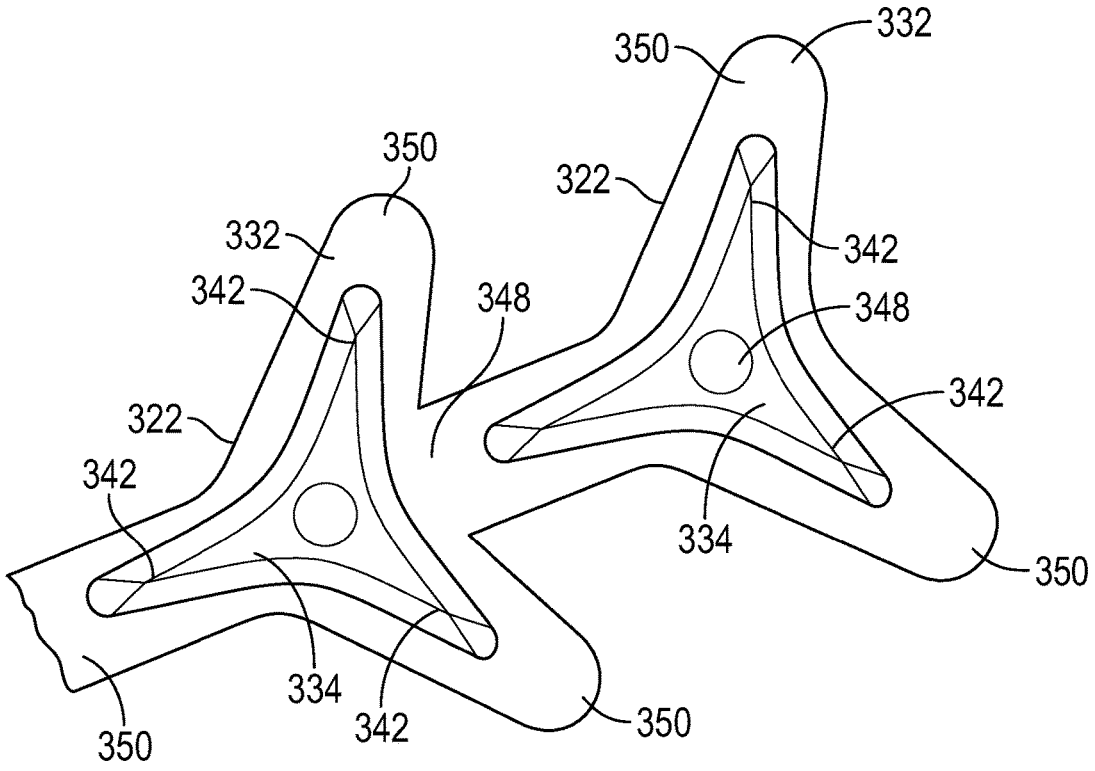
FIG. 6 is a schematic, fragmentary top view of traction members of the sole structure shown in FIG. 1.
Figure 7:
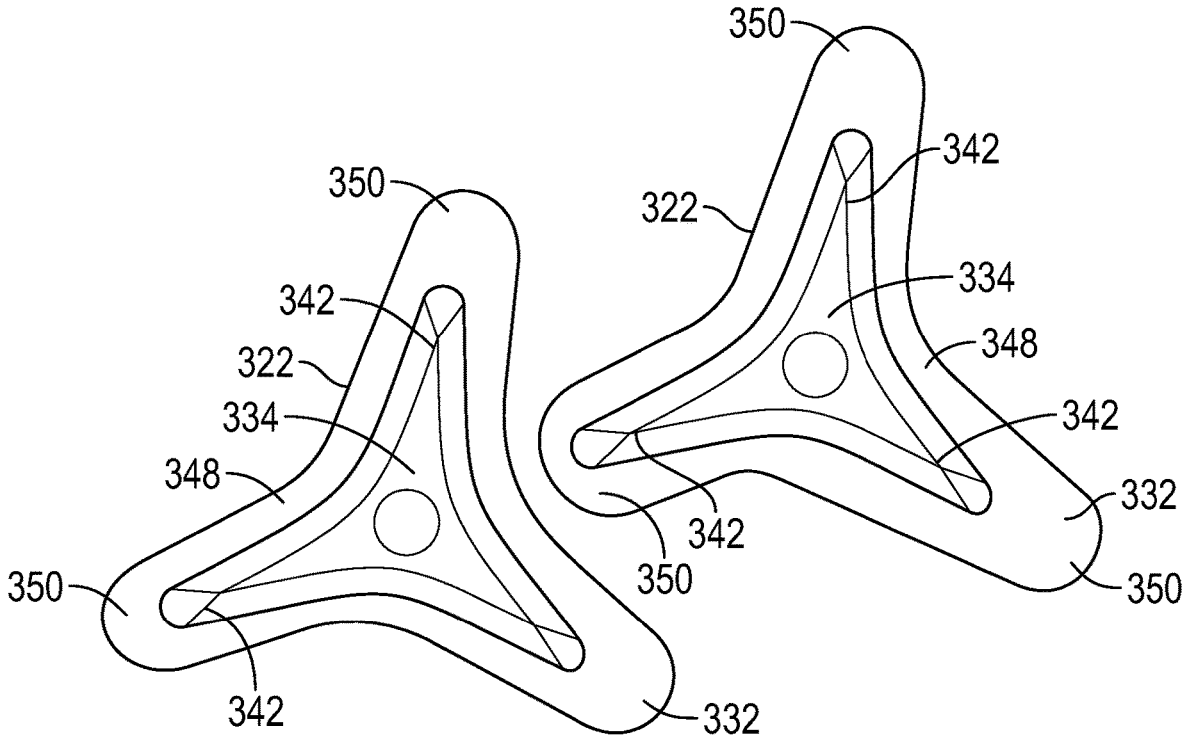
FIG. 7 is a schematic, fragmentary top view of traction members of a sole structure in accordance with another embodiment of the present disclosure.

The traction members 322 collectively form a traction assembly 320. In one embodiment, the traction assembly 320 is a single-piece or unitary structure including directly interconnected traction members 322 as shown in FIGS. 2 and 6, in order to enhance the structural integrity of the sole structure 103. Alternatively, the traction assembly 320 includes a plurality of traction members 322 that are not directly connected to each other, as shown in FIG. 7, in order to maximize the degrees of freedom of the traction assembly 320.

Each traction member 322 includes a base 332 and traction body 334 protruding from the base 332. Each base 332 has substantially planar cross-section, thereby allowing the traction member 322 to be firmly (but movably) supported by the inner midsole surface 150 of the midsole body 121. Further, the securing layer 428 can easily hold the traction members 322 in direct contact with the midsole body 121 because of the substantially planar cross-section of the base 332. It is desirable to maintain the traction members 322 in direct contact with the inner midsole surface 150 of the midsole body 121 to ensure that the traction members 322 fully protrude beyond the outer midsole surface 152 of the midsole component 122, which maximizes the traction capabilities of the traction members 322 while stilling enabling the traction members 322 to move relative to the midsole component 122. To facilitate movement of the traction members 322 relative to the midsole body 121, the traction members 322 are not directly bonded to the midsole component 122. Rather, the securing layer 428 is directly bonded (or otherwise directly attached) to the inner midsole surface 150 of the midsole body 121 and is disposed over the bases 332 of the traction members 322 in order to hold the traction members 322 in direct contact with the midsole component 122. Such bonding or attachment could be accomplished using any known methods for bonding components of articles of footwear, including, but not limited to: adhesives, films, tapes, stitching, or other methods. As a non-limiting example, an adhesive can be used to bond the securing layer 428 to the midsole body 121 at bonding locations B that are spaced apart from the bases 332 of the traction members 322. As a consequence, the securing layer 428 is not directly bonded to the traction members 322, thereby facilitating movement of the traction members 322. In other words, the traction members 322 are "free-floating" between the securing layer 428 and the midsole component 122. It is desirable to allow movement of the traction members 322 relative to the midsole component 122 during a golf swing, for example, in order to minimize foot slippage, while allowing foot flexion. As such, the sole structure 103 enables a golfer to enhance its distance, speed, and accuracy during a golf swing. The lack of bonding between the securing layer 428 and the traction members 322 further enables a natural motion of the sole structure 103 during a golf swing. The auxetic properties of the sole structure 103, which is enabled by the geometry and/or arrangement of the openings 200, also enables a natural motion of the sole structure 103 during a golf swing. In other words, the geometry of the openings 200 allows the sole structure 103 to mimic how the body and foot react to force and accounts for massive changes in foot size that occur throughout a golf swing. As a result, the auxetic properties of the sole structure 103 along with the lack of bonding between the securing layer 428 and the traction members 322 enhance the dynamism of the sole structure 103. By not directly adhering the traction members 322 to the midsole component 122 (i.e., permitting local relative translation), the traction assembly 320 does not constrain the auxetic nature of the midsole component 122, and permits a more natural movement of the sole structure 103.

The bases 332 of the traction members 322 are disposed outside the openings 200, thereby allowing the midsole body 121 to support the traction members 322. Specifically, the bases 332 of the traction members 322 abut the inner midsole surface 150, while the traction bodies 334 of the traction members 322 extend through the openings 200 past the outer midsole surface 152 in order to engage the ground. Each traction body 334 has a tapered cross-section to facilitate purchase with the ground.

Each traction body 334 includes a plurality of protrusions 342 and an apex 344 interconnecting all the protrusions 342 to one another. As a non-limiting example, each traction body 334 includes only three protrusions 342 converging into the apex 344 to maximize the grip of the traction member 322 to the ground. Each of the protrusions 342 extend from the base 332, and each is directly joined to one another at the apex 344 to maximize the grip of the traction member 322 to the ground. It is contemplated, however, that the traction body 334 may include more or fewer protrusions 342. The protrusions 342 are obliquely angled to one another in order to maximize the grip of the traction member 322 to the ground. Further, the maximize the grip of the traction member 322 to the ground while maintaining the flexibility of the midsole component 122, the hardness of the traction members 322 is greater than the hardness of the midsole body 121. For instance, the indentation hardness of the material (measured, for example, in the Shore C Hardness Scale) forming the midsole body 121 (i.e., the first hardness) is less than the indentation hardness of the material forming the traction members 322. As a non-limiting example, the hardness of the material forming the traction body 334 can be between twenty (20%) and thirty (30%) percent greater than the hardness of the material forming the midsole body 121 in order to minimize spin of at least one foot during the backswing and downswing stages of a golf swing. To this end, for example, the midsole body 121 may be wholly or partly made of EVA, and the traction bodies 334 may be wholly or partly made of TPU. Alternatively, the midsole body 121 and the traction bodies 334 can be made of the same or similar materials, but with different densities, in order to achieve the different hardnesses.

Figure 5:
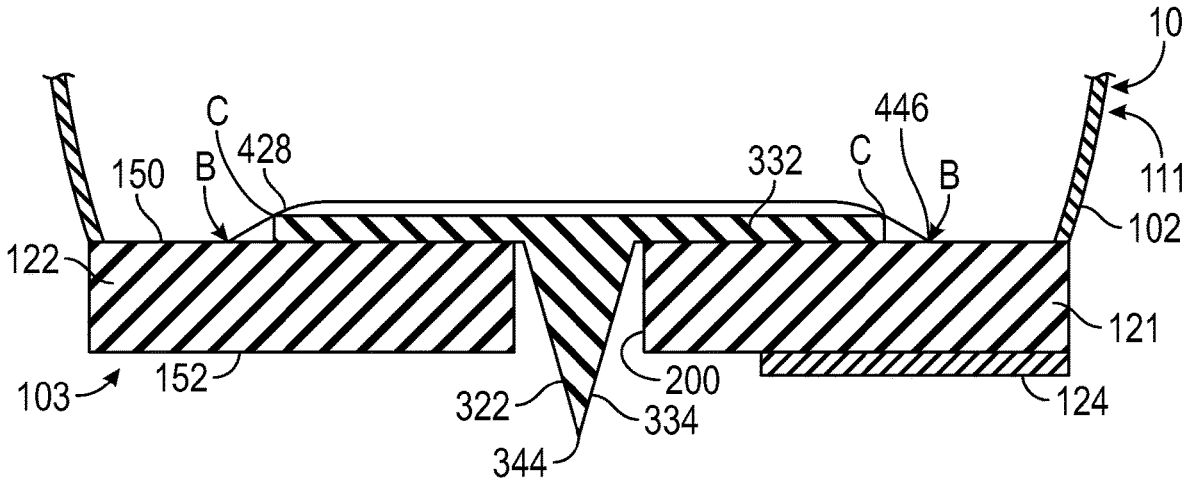
FIG. 5 is a schematic, sectional, fragmentary view of the sole structure shown in FIG. 1, taken along section line 5-5 of FIG. 3.

With reference to FIG. 5, the securing layer 428 is flexible to allow the traction members 322 to move relative to the midsole component 122. The securing layer 428 has an outermost edge 446, which surrounds the bases 332 of the traction members 322. In an embodiment, only the outermost edge 446 of the securing layer 428 is directly bonded to the inner midsole surface 150 of the midsole component 122 (at for example bonding locations B) to facilitate movement of the traction members 322 relative to the midsole component 122. In the depicted embodiment, the securing layer 428 is disposed over all the bases 332 of the traction members 322 to hold the traction members 322 in direct contact with the midsole component 122. In another embodiment, the outer layer surface 432 of the securing layer 428 is directly bonded to the bases 332 and midsole component 122 (at, for example, bonding locations C) to enhance the structural integrity of the sole structure 103.

Referring to FIGS. 6 and 7, as discussed above, each traction member 322 includes a base 332. Each base 332 includes a base hub 348 and a plurality of base legs 350 extending from the base hub 348. The base legs 350 are obliquely angled relative to one another to enhance the structural stability of the base 332. At least some of the bases 332 are directly connected to another base 332 to enhance the structural stability of the traction members 322. For example, in the embodiment depicted in FIG. 6, at least one of the base legs 350 of one traction member 322 is directly connected to the base hub 348 of another traction member 322, thereby creating a structurally stable web of traction members 322 (i.e., the traction assembly 320 of interconnected traction members 322). Alternatively, as shown in FIG. 7, the traction members 322, are not directly connected to one another to facilitate movement of each traction members 322 relative to the midsole component 122.

While the best modes for carrying out the teachings have been described in detail, those familiar with the art to which this disclosure relates will recognize various alternative designs and embodiments for practicing the teachings within the scope of the appended claims. The sole structure illustratively disclosed herein may be suitably practiced in the absence of any element which is not specifically disclosed herein. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings.

The invention claimed is:

1. A sole structure, comprising:

a midsole component including a midsole body, wherein the midsole body defines an outer midsole surface and an inner midsole surface opposite the outer midsole surface;

a plurality of traction members coupled to the midsole body, wherein each of the plurality of traction members includes a base and a traction body protruding from the base away from the inner midsole surface, the traction body extends through the midsole body, the base abuts the inner midsole surface such that the plurality of traction members are movable relative to the midsole body;

a securing layer disposed over the base, wherein the securing layer is coupled to the inner midsole surface to hold the plurality of traction members in contact with the midsole component;

wherein the plurality of traction members are directly interconnected to each other;

wherein the securing layer holds the plurality of traction members and the midsole component together;

wherein a pocket is defined between the inner midsole surface and the securing layer;

wherein the base of the plurality of traction members is disposed inside the pocket and is free-floating inside the pocket;

wherein the securing layer is directly bonded to the inner midsole surface at bonding locations;

wherein the base of each of the plurality of traction members has an outermost base edge;

wherein each of the bonding locations is spaced apart from the outermost base edge of the base to define a void between the outermost base edge and the bonding locations; and wherein the securing layer includes an outermost edge, the outermost edge of the securing layer surrounds the base of each of the plurality of traction members, only the outermost edge of the securing layer is directly bonded to the inner midsole surface of the midsole component, the outermost edge of the securing layer is directly bonded to the inner midsole surface at the bonding locations, each of the bonding locations is spaced apart from the base of each of the plurality of traction members to define the void between the bonding locations and the outermost base edge, the inner midsole surface has an outermost perimeter, and a plurality of the bonding locations are closer to the outermost base edge than to the outermost perimeter of the inner midsole surface.

2. The sole structure of claim 1, wherein the plurality of traction members are not directly bonded to the midsole component, the plurality of traction members includes a first traction member and a second traction member, the base of each of the first traction member and the second traction member includes a base hub and a plurality of base legs extending directly from the base hub, and a base leg of the plurality of base legs of the first traction member is directly connected to the base hub of the second traction member, and the securing layer is coupled to the inner midsole surface to hold the plurality of traction members in direct contact with the inner midsole surface of the midsole component.

3. The sole structure of claim 1, wherein the securing layer is not directly bonded to the plurality of traction members.

4. The sole structure of claim 1, wherein the traction body includes a plurality of protrusions and an apex, each of the plurality of protrusions extends from the base, and each of the plurality of protrusions are directly joined to one another at the apex.

5. The sole structure of claim 4, wherein the plurality of protrusions are obliquely angled relative to one another.

6. The sole structure of claim 5, wherein the midsole component defines a plurality of openings, each of the plurality of openings extends between the inner midsole surface and the outer midsole surface, and each of the plurality of openings receives the traction body of one of the plurality of traction members.

7. The sole structure of claim 6, wherein the base of each of the plurality of traction members is outside the plurality of openings.

8. The sole structure of claim 7, wherein the plurality of openings is arranged on the midsole component such that the midsole component defines an auxetic structure.

9. The sole structure of claim 8, wherein the base of each of the plurality of traction members is directly connected to each other.

10. The sole structure of claim 9, wherein the base includes a base hub and a plurality of base legs extending from the base hub.

11. The sole structure of claim 10, wherein at least one of the base legs is directly connected to the base hub.

12. The sole structure of any of claim 11, wherein the midsole body has a first hardness, each of the plurality of traction members has a second hardness, and the second hardness is greater than the first hardness.

13. An article of footwear, comprising:

an upper;

a midsole component coupled to the upper, wherein the midsole component includes a midsole body, and the midsole body defines an outer midsole surface and an inner midsole surface opposite the outer midsole surface; and a plurality of traction members coupled to the midsole body, wherein each of the plurality of traction members includes a base and a traction body protruding from the base away from the inner midsole surface, the traction body extends through the midsole body, the base abuts the inner midsole surface such that the plurality of traction members are movable relative to the midsole body;

a securing layer disposed over the base, wherein the securing layer is coupled to the inner midsole surface;

wherein the plurality of traction members includes a first traction member and a second traction member, the base of each of the first traction member and the second traction member includes a base hub and a plurality of base legs extending from the base hub, and a base leg of the plurality of base legs of the first traction member is directly connected to the base hub of the second traction member;

wherein the securing layer holds the plurality of traction members and the midsole component together;

wherein a pocket is defined between the inner midsole surface and the securing layer; and wherein the base of the plurality of traction members is disposed inside the pocket and is free-floating inside the pocket;

wherein the securing layer is directly bonded to the inner midsole surface at bonding locations;

wherein the base of each of the plurality of traction members has an outermost base edge;

wherein each of the bonding locations is spaced apart from the outermost base edge of the base to define a void between the outermost base edge and the bonding locations; and wherein the securing layer includes an outermost edge, the outermost edge of the securing layer surrounds the base of each of the plurality of traction members, only the outermost edge of the securing layer is directly bonded to the inner midsole surface of the midsole component, the outermost edge of the securing layer is directly bonded to the inner midsole surface at the bonding locations, each of the bonding locations is spaced apart from the base of each of the plurality of traction members to define the void between the bonding locations and the outermost base edge, the inner midsole surface has an outermost perimeter, and a plurality of the bonding locations are closer to the outermost base edge than to the outermost perimeter of the inner midsole surface.

14. The article of footwear of claim 13, wherein the securing layer is not directly bonded to the plurality of traction members.

15. The article of footwear of claim 14, wherein the plurality of traction members are not directly bonded to the midsole component.

16. The article of footwear of claim 15, wherein the traction body includes a plurality of protrusions and an apex, each of the plurality of protrusions extends from the base, each of the plurality of protrusions are directly joined to one another at the apex, and the plurality of protrusions are obliquely angled relative to one another.

17. A sole structure, comprising:

a midsole component including a midsole body, wherein the midsole body defines an outer midsole surface and an inner midsole surface opposite the outer midsole surface, the midsole component defines a plurality of openings, each of the plurality of openings extends between the inner midsole surface and the outer midsole surface, and the plurality of openings have an auxetic configuration;

a plurality of traction members coupled to the midsole body, wherein each of the plurality of traction members includes a base and a traction body protruding from the base away from the inner midsole surface, the traction body extends through the midsole body, the base abuts the inner midsole surface such that the plurality of traction members are movable relative to the midsole body, and each of the plurality of openings receives the traction body of one of the plurality of traction members; and a securing layer disposed over the base, wherein the securing layer is coupled to the inner midsole surface to hold the plurality of traction members in contact with the midsole component;

wherein the securing layer holds the plurality of traction members and the midsole component together; wherein the base of the plurality of traction members is disposed inside the pocket and is free-floating inside the pocket;

wherein the securing layer is directly bonded to the inner midsole surface at bonding locations;

wherein the base of each of the plurality of traction members has an outermost base edge;

wherein each of the bonding locations is spaced apart from the outermost base edge of the base to define a void between the outermost base edge and the bonding locations; and wherein the securing layer includes an outermost edge, the outermost edge of the securing layer surrounds the base of each of the plurality of traction members, only the outermost edge of the securing layer is directly bonded to the inner midsole surface of the midsole component, the outermost edge of the securing layer is directly bonded to the inner midsole surface at the bonding locations, each of the bonding locations is spaced apart from the base of each of the plurality of traction members to define the void between the bonding locations and the outermost base edge, the inner midsole surface has an outermost perimeter, and a plurality of the bonding locations are closer to the outermost base edge than to the outermost perimeter of the inner midsole surface.

* * * * *